US006674067B2

(12) United States Patent
Grosshans et al.

(10) Patent No.: US 6,674,067 B2
(45) Date of Patent: Jan. 6, 2004

(54) METHODS AND APPARATUS TO CONTROL CHARGE NEUTRALIZATION REACTIONS IN ION TRAPS

(75) Inventors: Peter B. Grosshans, Princeton, NJ (US); Chad M. Ostrander, Austin, TX (US); Craig A. Walla, Fremont, CA (US)

(73) Assignee: Hitachi High Technologies America, Inc., San Jose, CA (US)

( * ) Notice: Subject to any disclaimer, the term of this patent is extended or adjusted under 35 U.S.C. 154(b) by 0 days.

(21) Appl. No.: 10/188,577

(22) Filed: Jul. 2, 2002

(65) Prior Publication Data

US 2003/0155502 A1 Aug. 21, 2003

Related U.S. Application Data

(63) Continuation-in-part of application No. 10/081,243, filed on Feb. 21, 2002, now Pat. No. 6,570,151.

(51) Int. Cl.[7] ..... H01J 49/42
(52) U.S. Cl. ..... 250/282; 250/292
(58) Field of Search ..... 250/281–283, 250/285, 292, 489

(56) References Cited

U.S. PATENT DOCUMENTS

| | | | | |
|---|---|---|---|---|
| 3,065,640 A | | 11/1962 | Langmuir et al. | |
| 4,540,884 A | | 9/1985 | Stafford et al. | |
| RE34,000 E | | 7/1992 | Syka et al. | |
| 5,572,022 A | * | 11/1996 | Schwartz et al. | 250/282 |

OTHER PUBLICATIONS

Scott A. McLuckey, Gavin E. Reid and J. Mitchell Wells, "Ion Parking During Ion/Ion Reactions In Electrodynamic Ion Traps", Analytical Chemistry, vol. 74, No. 2, pp. 336–346, Jan. 15, 2002.

Scott A. McLuckey, James L. Stephenson, Jr. and Keiji G. Asano, "Ion/Ion Proton–Transfer Kinetics: Implications For Analysis Of Ions Derived From Electrospray Of Protein Mixtures", Analytical Chemistry, vol. 70, No. 6, pp. 1198–1202, Mar. 15, 1998.

Raymond E. March and Frank A. Londry, Chapter 2, "Theory Of Quadrupole Mass Spectrometry", pp. 25–48, published in "Practical Aspects Of Ion Trap Mass Spectrometry", vol. 1, edited by Raymond E. March and John F.J. Todd, CRC Press, Inc., copyright 1995.

Hitachi Spectrometer "Model M–8000 Hitachi LC3DQMS System" brochure (8 pages including cover and back) published Mar. 2000.

* cited by examiner

*Primary Examiner*—John R. Lee
*Assistant Examiner*—Christopher M. Kalivoda
(74) *Attorney, Agent, or Firm*—Ronald L. Wanke; Jenner & Block, LLC

(57) ABSTRACT

An ion trap mass spectrometer uses electrospray ionization to introduce multiply-charged positive ions in an axial direction into a quadrupole ion trap and glow discharge ionization to introduce singly-charged negative ions in a radial direction into the ion trap. Methods of controlling ion-to-ion charge transfer reactions include applying a combination of a dipolar DC voltage and a dipolar RF voltage across endcap electrodes to allow partial charge state neutralization reactions to occur between the positive and negative ions and then control suspension and resumption of further charge state neutralization reactions. The remaining ions can be further processed and transformed and a mass spectrum created by scanning a quadrupolar RF field.

33 Claims, 8 Drawing Sheets

METHODS AND APPARATUS TO CONTROL CHARGE NEUTRALIZATION REACTIONS IN ION TRAPS

CROSS-REFERENCE TO RELATED APPLICATION

This is a continuation-in-part of Ser. No. 10/081,243 filed on Feb. 21, 2002 entitled "Methods And Apparatus To Control Charge Neutralization Reactions In Ion Traps", issued as U.S. Pat. No. 6,570,151).

TECHNICAL FIELD

The present invention relates to methods and apparatus to control charge neutralization reactions between positive ions and negative ions in ion traps used for mass spectrometry.

BACKGROUND OF THE INVENTION

Ion trap mass spectrometers, also known as quadrupole ion storage devices or Paul ion traps, use various combinations of RF and DC electric potentials applied to endcaps and ring electrodes which give rise to RF and DC electric fields that trap and manipulate ions. Various electric potentials are known including RF and DC quadrupolar and dipolar potentials. Electrospray ionization (ESI) and other ionization methods can produce multiply-charged analyte ions from large molecules including peptides and proteins and others. This permits certain analysis of high mass molecules by a mass spectrometer having a lower mass-to-charge range. It is also known to introduce counter ions of opposite charge, including singly-charged counter ions, which will react by ion/ion charge transfer reactions, including proton transfer reactions, to migrate the analyte ions to lesser multiple charged states which represent higher mass-to-charge ratios. However, it has been difficult to control the ion to ion transfer reactions so as to manipulate and/or control the ion/ion reactions for practical use in mass spectrometry.

One known method to selectively inhibit rates of ion/ion reactions in a quadrupole ion trap is to apply dipolar RF signals to the endcap electrodes to cause resonance excitation at or near the ion of interest. All of the higher charge state ions can undergo rapid ion/ion reactions until such time as they fall into the region of the Mathieu stability diagram where they become "parked" by virtue of the reduced ion/ion reaction rates for the accelerated charge state. This method is described by Scott A. McLuckey Gavin E. Reid and J. Mitchell Wells, in "Ion Parking During Ion/Ion Reactions In Electrodynamic Ion Traps", Analytical Chemistry, Vol. 74, Issue 2, pages 336–346, published Jan. 15, 2002.

SUMMARY OF THE INVENTION

The present invention includes new methods and apparatus to control charge neutralization reactions between positive ions and negative ions which are simultaneously trapped in a Paul type ion trap. The ion/ion reactions can be inhibited and/or suspended so as to allow further processing and/or analysis of the ion products. This is particularly useful for concentrating analyte ions in a particular charge state for subsequent processing such as purification, collision induced dissociation (CID), and mass analysis. Such concentration is particularly useful for the analysis of mixtures of high mass molecules such as proteins.

It is an object of the present invention to provide new methods and apparatus for operating an ion trap to control the progression of the ion/ion charge transfer reactions between simultaneously-trapped positive and negative ions to facilitate further processing and mass analysis.

It is another object of the present invention to provide methods and apparatus for generating and using combinations of dipolar DC and dipolar RF signals across endcap electrodes in a manner to manipulate and control ion/ion reactions in an ion trap containing positive and negative ions.

It is a further object of the present invention to provide methods and apparatus to apply dipolar DC and dipolar RF potentials to induce suspension and force resumption of charge state neutralization reactions and to quench further reactions in a manner controllable by an operator so as to select one or more target charge states for further processing and mass analysis.

DETAILED DESCRIPTION OF THE EMBODIMENTS

Figure 1:
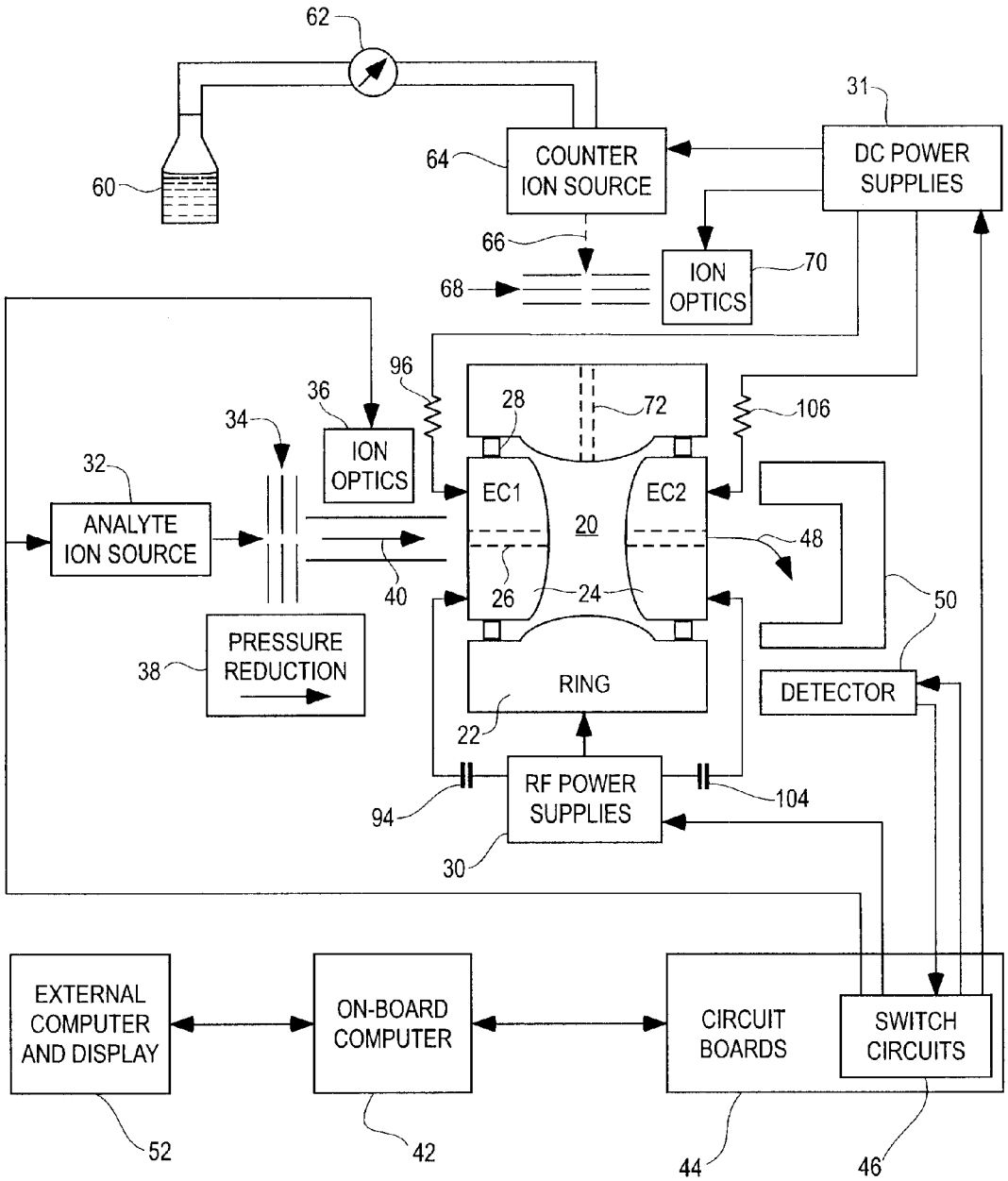
FIG. 1 is an overall block and schematic diagram of a quadrupole ion trap and associated control system in accordance with the present invention.

Turning to FIG. 1, a Paul type ion trap 20 includes an annular ring electrode 22 of radius $r_0$ and a pair of endcap electrodes 24 which can vary from each other due to asymmetric stretch and different size apertures. One endcap is labeled EC1, and the other is labeled EC2. Each endcap has aperture openings 26 for the passage of ions through the endcap. A pair of quartz insulating rings 28 electrically isolates the ring electrode 22 from the pair of endcap electrodes 24. The ring electrode 22 has an interior surface which obeys $r^2 - 2z^2 = r_0^2$, or nearly so until it is truncated. The endcaps have interior surfaces which obey $r^2 - 2z^2 = -2z_0^2$, or nearly so until they are truncated. The endcaps 24 and ring 22 form a generally hyperbolic electrode structure which may be somewhat distorted or stretched as is well-known.

RF power supplies 30 generate several radio frequency (RF) signals coupled to the endcaps 24 and ring 22 to control the ion trap 20. One-RF drive signal is applied to the ring electrode to establish within the enclosed volume a substantially quadrupolar RF electric field which can have superimposed thereon other higher multipole fields such as a hexapole field and/or an octopole field, etc. This substantially quadrupolar field has a variable RF voltage amplitude V at a frequency f such as 1 MHz. Ions having a specific range of mass-to-charge (m/z) ratio can be stably trapped inside the ion trap by the trapping RF potential. Other electrode geometries are known which, together with applied RF signals, can also be used to trap ions in a substantially equivalent manner.

Trapping potentials can be formed by an infinite variety of electrode geometries with applied voltages, but the fields generally have a substantial component, E, which varies linearly with position, or, potentially, several such components. Mathematically, this linear component behaves as follows:

$$E=f(t)\{\alpha x+\beta y+\gamma z\} \text{ where} \quad (1)$$

$$\alpha+\beta+\gamma=0 \text{(to satisfy the Laplace Equation)} \quad (2)$$

in which f(t) is some periodic amplitude, and x, y and z represent the vector position in space where the field is to be evaluated. Similarly, a dipolar potential will have a substantial component which is spatially homogenous (independent of position in the field) that may be time-varying.

DC power supplies 31 generate several direct current (DC) voltages coupled to the ion trap and ion optics. This can include an optional DC voltage of variable amplitude U which can be combined with the quadrupolar RF field to vary the operating and scan parameters for the ion trap 20 in a known manner.

An analyte ion source 32 creates analyte or sample ions which are electrostatically focused by DC voltages coupled to lenses 34 controlled by ion optics circuitry 36. Pressure reduction stages 38, illustrated diagrammatically, reduce the pressure from atmospheric of about 760 Torr at the input of the analyte ion source to a substantial vacuum of about $1.0\times10^{-4}$ Torr where a stream of analyte ions 40 enter the aperture 26 through the endcap EC1. Many different methods of forming and transferring multiply-charged analyte ions to the ion trap are known.

An on-board computer 42 controlled by firmware and software generates control signals to circuit boards 44 which generate the various signals for controlling the ion trap and its various operating parameters including temperature and the like. The circuit boards 44 include a variety of switch circuits 46 which generate switch signals coupled to circuits which apply signals to various electrodes within the instrument. The ion trap can perform, for example, collision induced dissociation (CID) of parent ions into daughter ions, and other types and higher orders of MS/MS analysis.

After manipulation of the ions in the ion trap, the RF power supplies 30 generate a quadrupolar RF scan voltage with an amplitude V increasing along a linear ramp in order to cause ions remaining within the trap to be ejected in mass sequential order including through the aperture 26 of the endcap EC2. The resulting ion exit stream 48 is deflected to a detector 50 such as a conversion dynode/photoelectron multiplier detector system. The current output of the detector 50 is coupled to the on-board computer 42 to record the resulting mass spectra. Typically, the on-board computer 42 communicates over a bus with an external computer 52 including a connected CRT display device for further analysis and/or display of the results. Other forms of mass-to-charge analysis are possible and are well known.

The overall system to the extent described above is known and available from several manufacturers. For example, the system can be an LC/3DQMS system, Model M-8000, made by Hitachi, Ltd. and distributed by Hitachi Instruments, Inc. of San Jose, Calif., now Hitachi High Technologies America, Inc., the assignee of this application. This LC/MS/MS system is available with an Electrospray ionization (ESI) interface used herein for the analyte ion source 32. As is known, an ESI source provides multiply-charged ions from a sample to be analyzed, and the resulting analyte ions have a broad range of charge states. For example, the electrospray can produce positive analyte ions having charge states from +1 through +25 or higher, but the electrospray of an analyte such as DNA or RNA can produce multiply-charged negative analyte ions of high charge states.

Figure 3:
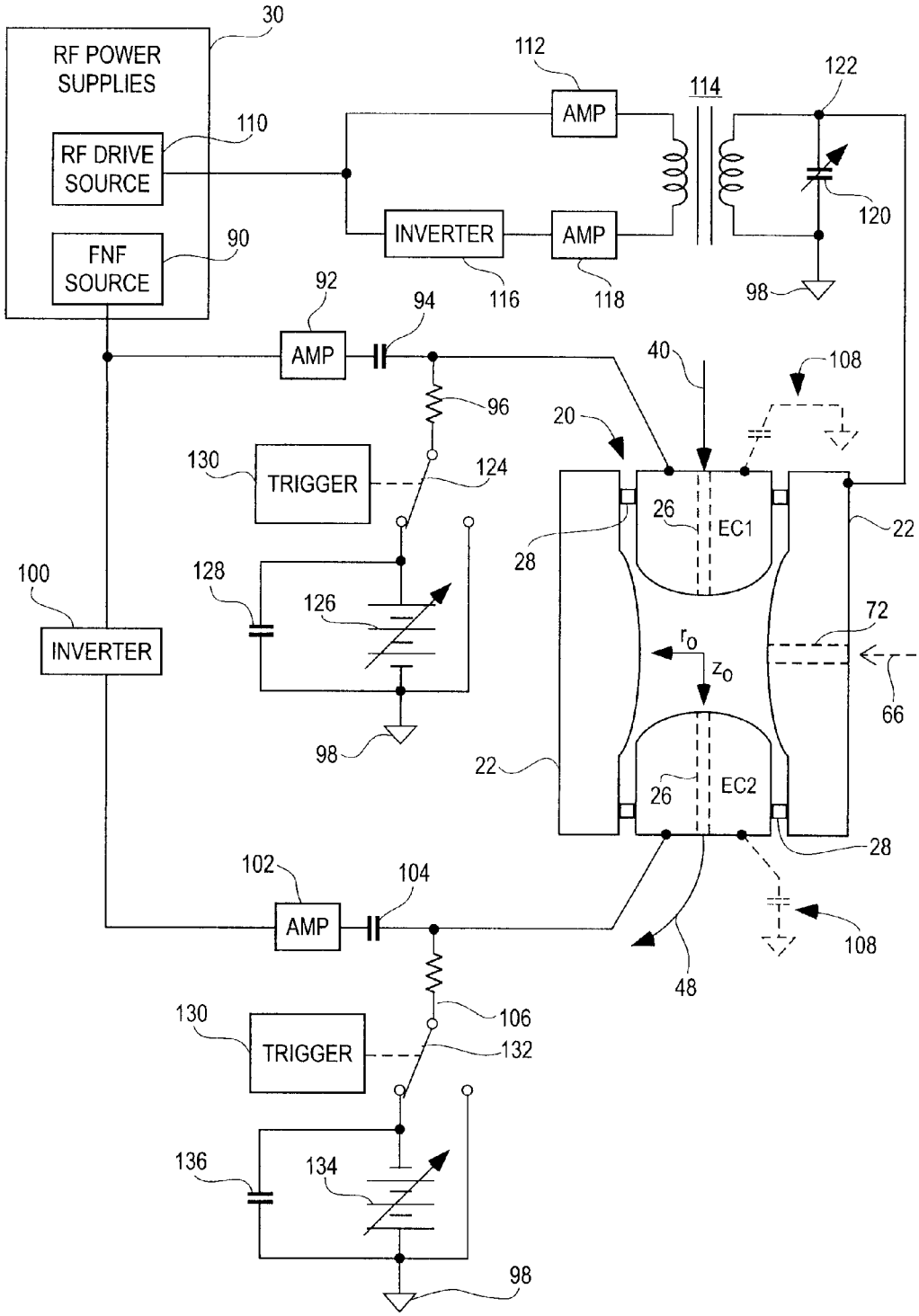
FIG. 3 is a partly block and partly schematic diagram of a portion of the control system for applying dipolar DC and dipolar RF signals and quadrupolar RF drive to the ion trap of FIG. 1.
Figure 5:
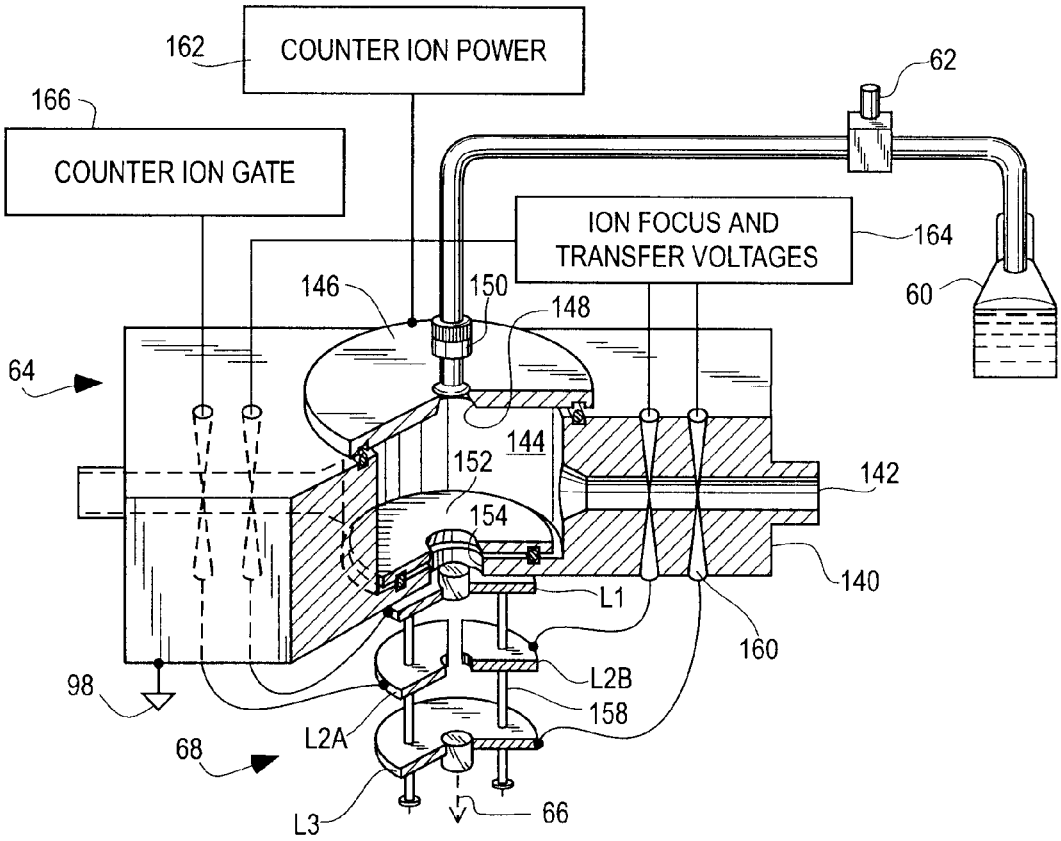
FIG. 5 is a partly block and partly schematic diagram of the counter ion source and associated DC power supplies of FIG. 1.

The system described above is modified by the addition of further apparatus as shown in FIGS. 1, 3 and 5, and is operated in accordance with the process steps of the remaining figures. A reagent reservoir 60 supplies a reagent sample through a precision leak valve 62 to a counter ion source 64 which produces ions of counter or opposite charge to those produced by the analyte ion source 32. When the analyte ion source 32 produces positive ions, then the counter ion source 64 should produce negative ions. Depending on the counter ion source, these counter ions may be singly charged such as having a −1 charge or may be multiply-charged. The counter ion source 64 can be a glow discharge ionization (GDI) source to be explained later.

A stream 66 of singly-charged negative counter ions from source 64 are electrostatically focused by lenses 68 controlled by ion optics circuitry 70. An aperture 72 extends radially through the ring electrode 22 so that the counter ion stream 66 enters the interior of the ion trap 20 along a radial direction r. The radius of the annular ring 22 is $r_0$. As seen in FIG. 3, the multiply-charged positive analyte ions 40 enter the ion trap along an axial axis z. The distance from the center of the ion trap to the endcap EC2 is $z_0$ (or slightly more for a stretched trap). The direction of introduction of either the analyte ions or the counter ions can be varied.

The RF power supplies 30 and DC power supplies 31 are operated to simultaneously trap the analyte ions and the counter ions within the center of the ion trap 20. In addition, the DC power supplies 31 provide dipolar DC voltages which serve to substantially separate in space the positive ions from the negative ions to inhibit ion/ion reactions between the positive ions and the negative ions, as will be explained.

Figure 2A:
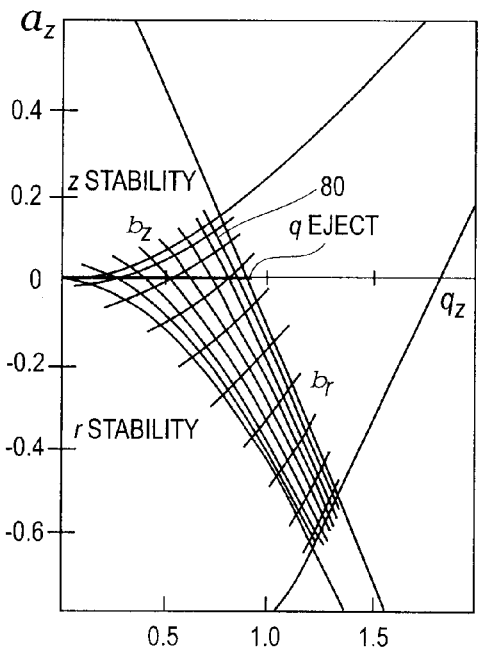
FIGS. 2*a* to 2*c* are Mathieu stability diagrams for the ion trap of FIG. 1.
Figure 2B:
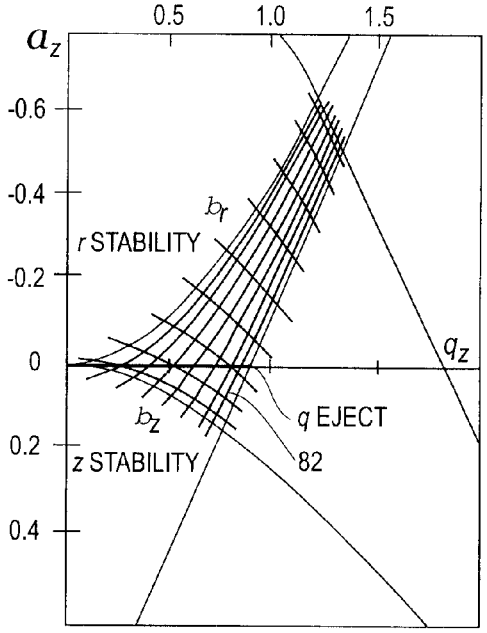
Figure 2C:
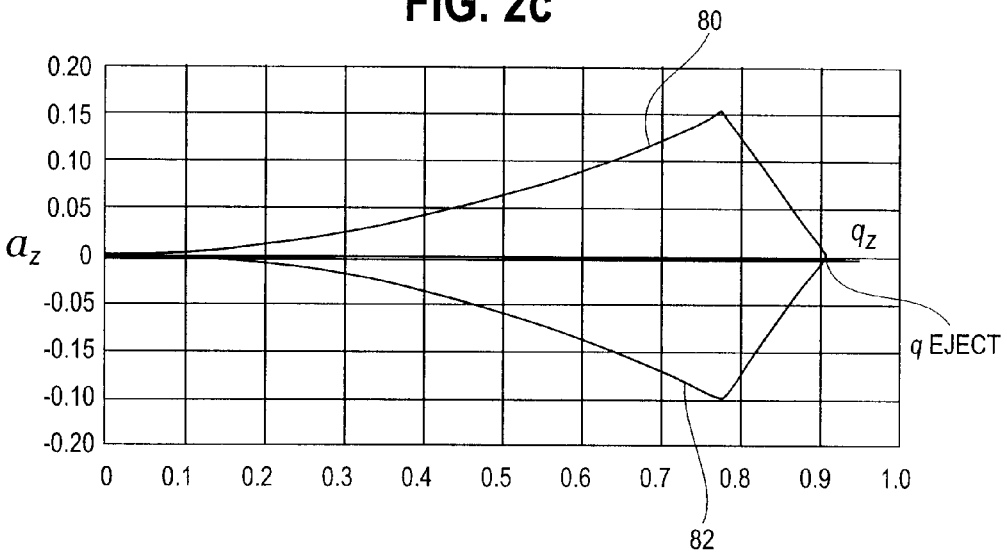

FIGS. 2*a* to 2*c* are Mathieu stability diagrams showing the regions of stability for the three-dimensional ion trap 20 about $a_z$ and $q_z$ axes. FIG. 2*a* indicates the stability diagram for positive ions, which in an exemplary embodiment herein are multiply-charged analyte ions. FIG. 2*b* is a mirror image and shows the stability diagram for negative ions, which in an exemplary embodiment are singly charged reagent ions of −1 charge. The parameters $a_z$ and $q_z$ for these Mathieu stability diagrams are defined as:

$$a_z = \frac{-8qU}{mr_0^2\omega^2} \quad (3)$$

$$q_z = \frac{4qV}{mr_0^2\omega^2} \quad (4)$$

where

V=magnitude of quadrupolar RF voltage

U=amplitude of quadrupolar DC voltage q=charge born by the charged particle.

m=mass of charged particle $r_0$=radius of ring electrode from center

ω=angular frequency of quadrupole RF voltage

For any particular ion, the values of $a_z$ and $q_z$ must be within the stability envelope if the ion is to be trapped within the quadrupolar RF and quadrupolar DC fields.

A bounded region 80 shown in FIG. 2*a* above the $a_z$=0 axis is stable for positive ions, and overlaps a corresponding region of stability in FIG. 2*b* for negative ions. A bounded region 82 shown in FIG. 2*b* below the $a_z$=0 axis is stable for negative ions, and overlaps a corresponding region of stability in FIG. 2*a* for positive ions. FIG. 2*c* is an expanded Mathieu stability diagram and illustrates that positive ions and negative ions will be simultaneously stable and trapped if they map within the envelopes of the regions 80 and 82. The ion trap 20 of FIG. 1 is operated by adjusting the quadrupolar RF drive parameter V so that at least some of the positive analyte ions from source 32 and at least some of the negative counter ions from source 64 map within the regions 80 and 82 of FIG. 2C. A typical quadrupolar RF frequency is 1 MHz or so. The quadrupolar DC component U is typically set to 0 volts.

FIG. 3 illustrates in more detail a portion of the circuit for applying dipolar DC and dipolar RF signals across the endcaps EC1 and EC2 and quadrupolar RF drive to the ring of the ion trap 20. The RF power supplies 30 include a source 90 of supplemental RF signals having an adjustable frequency range, also called FNF and/or supplemental AC having a variable frequency. FNF is an abbreviation for Filtered Noise Fields, which are supplemental RF signals generated with a selectable narrow to wide bandwidth which span a frequency range from about 10 KHz to about half of the RF drive frequency such as 400 KHz, have a variable amplitude from a few millivolts (mV) to ten volts, and also can include frequency notch(es) within the bandwidth. A further description of an exemplary FNF waveform will be described later with respect to FIG. 7.

The supplemental RF waveform generator 90 generates broad or narrow band signals depending on the purpose of the dipolar RF field. The dipolar FNF fields may be used to eject unwanted ions from the trap as, for example, when isolating a parent ion for subsequent MS/MS analysis. In this case, the supplemental RF signal is broadband ranging from about 10 kHz up to about one-half of the quadrupolar RF Drive frequency (about 500 kHz) with a notch at the axial frequency of the parent ion. For collision induced dissociation or CID, the FNF is typically narrowband and ranges in bandwidth from a single frequency to a few kHz. During mass analysis, the supplemental RF signal is typically a single frequency corresponding to a particular point along the $q_z$ axis of the stability diagram. Manipulation of trapped ions for isolation and CID using dipolar RF fields such as FNF is well known.

As seen in FIG. 3, the FNF source 90 is coupled through an amplifier 92 and a blocking capacitor 94 to the endcap EC1. A resistor 96 can be directly connected to ground 98, also called AG for analog ground or chassis ground. The FNF source 90 is also coupled through an inverter 100 and amplifier 102 and blocking capacitor 104 to the other endcap EC2. A resistor 106 can be directly connected to ground 98. Each endcap presents a small stray capacitance to ground, as represented by the dashed lines 108. Typical values for blocking capacitors 94 and 104 are 2.2 uF and for resistors 96 and 106 are 50 ohm. Amplifiers 92 and 102 are formed by operational amplifiers which are matched in gain and characteristics. The resulting circuit applies RF signals to EC1 and EC2 which are of opposite polarity, i.e. 180° out of phase, thereby creating a substantially dipolar RF potential in the interior of the trap.

The RF power supplies 30 also include an RF drive source 110 for generating an RF trapping drive signal applied to the ring to trap ions. The source 110 is coupled through an amplifier 112 to one side of input windings of a transformer 114, and through an inverter 116 and amplifier 118 to the other side of the input windings of transformer 114. A variable capacitor 120 across the output windings is adjusted to establish resonance of the circuit with the applied signal. One side 122 of the output windings is coupled to the ring electrode 22, and the other side of the output windings is coupled to ground 98. This creates within the ion trap 20 a substantially quadrupolar RF potential for trapping of the positive ions and the negative ions accumulated within the ion trap.

The circuit of FIG. 3 to the extent described above is known. This circuit is modified by a pair of manually adjustable DC voltage sources connected with opposite polarities, i.e. dipolar, to the endcaps EC1 and EC2. More particularly, a switch 124 has one switch terminal connected to a DC voltage supply 126 having a manually preset adjustable voltage. An optional capacitor 128 can be in parallel therewith to stabilize the DC voltage during switching. A trigger circuit 130 controls the switch 124 for connecting one polarity DC voltage, of an amplitude manually preset by the operator, to the endcap EC1.

Similar circuitry of opposite polarity is added to the other channel for endcap EC2. Namely, a switch 132 has one switch terminal connected to a separate adjustable DC voltage source 134 connected with ground 98. The magnitude of DC source 134 can be manually preset by the operator. An optional parallel capacitor 136 can be used to stabilize the fixed DC voltage during switching. Switch 132 is controlled by the trigger circuit 130. The adjustable DC power supply 134 has an opposite polarity to the supply 126, and therefore couples the opposite polarity DC voltage to endcap EC2. Typical values for the capacitors 128 and 136 are 100 uF.

Switches 124 and 132 can be ganged together, and are controlled by the common trigger circuit 130 which is under software control. While EC1 is shown biased to a positive DC voltage and EC2 is shown biased to a negative DC voltage, hence dipolar, the polarities can be reversed. To achieve truly dipolar DC, the two DC supplies 126 and 134 should apply voltages of the same absolute magnitude but of opposite polarity. Any difference between the DC voltages applied to the endcaps will give rise to a dipolar component to the DC potential field within the trap. In the exemplary embodiment, equal but opposite DC voltages are used to avoid the introduction of a quadrupolar DC field into the interior of the trap. In alternate embodiments, the software control can permit individual and independent adjustment of the +DC magnitude and of −DC magnitude for each endcap. Or, one endcap can be kept at ground potential of 0 volts.

Figure 4:
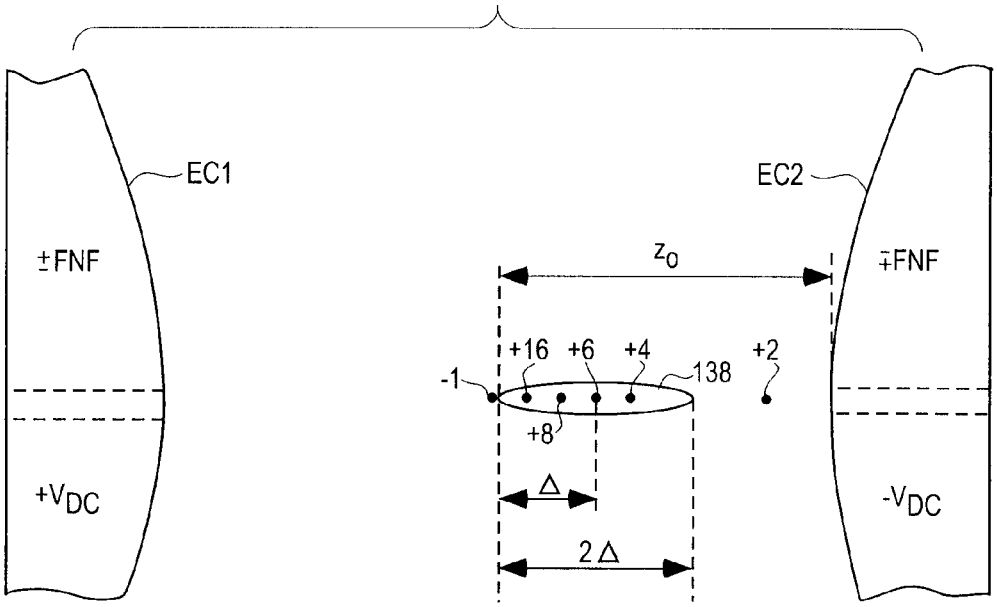
FIG. 4 is an exploded view showing axial dispersion of positive ions and negative ions under the influence of dipolar DC and dipolar RF signals between the endcaps of the ion trap of FIG. 1.

FIG. 4 shows schematically several axial displacements for different charge states of multiply-charged positive analyte ions and singly-charged negative counter ions when $+V_{DC}$ is applied to endcap EC1, $-V_{DC}$ is applied to endcap EC2, and a supplemental RF signal known as FNF is applied dipolar to the pair of endcaps EC1 and EC2. By way of example, the relative axial positions of the +2, +4, +6, +8 and +16 analyte ions (not all of which may be present at one time) and the −1 counter ion is illustrated for one set of trapping and dipolar DC and dipolar RF parameters. The distance $z_0$ represents the fixed distance from the ion trap center to the endcap EC2 (or slightly more for a stretched trap). A displacement Δ represents the variable distance from the ion trap center to a center of orbit for an ion of a particular charge state. The displacement Δ is shown illustratively in the figure for a +6 analyte ion. As can be seen, positive ions are pulled towards endcap EC2 due to the attraction of $-V_{DC}$, whereas the negative ions are shifted slightly away from the geometric center towards the $+V_{DC}$ potential on endcap EC1. Furthermore, lower charge states such as +2 and +4 (which represent higher m/z ions) are shifted more away from the geometric center of the trap, and hence further away from possible reactions with the −1 counter ions due to the influence of the dipolar DC amplitudes.

The trapped ions are influenced by the combined effect of the superimposed dipolar DC and dipolar FNF signals. The amplitudes and frequencies of the dipolar FNF signals and the amplitude of the dipolar DC signal are selected to control charge state migrations and the final charge state distribution of the ions. By way of explanation, the effect on the ions of the dipolar DC will be described first. Then, the superimposed effect of the FNF signal and its relationship to the dipolar DC signal will be described second.

The absolute magnitude of $V_{DC}$ can be adjusted, along with certain other parameters, to control the amount of displacement Δ for analyte ions of a particular charge state. Greater distances of Δ move analyte ions further away from the center, and when sufficiently far enough away will suppress reactions with counter ions (absent the effect of the FNF signal). For the illustrated condition in which the +2 charge state is located close to endcap EC2, those +2 ions are sufficiently far away from the −1 counter ions to be unable or unlikely to react with the counter ions. In contrast, the much higher charge states, such as +16, are significantly closer to the −1 counter ions and will react as the orbits overlap.

To selectively halt the CSM process at a particular charge state, the operator adjusts the control system to preselect certain time periods of interaction, the magnitude of $V_{DC}$, and certain other parameters to be explained, so as to effectively select a target charge state. The relationship between the quadrupolar RF drive and the dipolar DC signal can be derived in the following manner. The interaction and relationship with the dipolar FNF signal, which selectively resumes the CSM process, will be described later. With $\pm V_{DC}$ applied to the endcaps, the force, F, exerted on a trapped ion of charge q and mass m by the resulting potential is approximately given as:

$$F = \frac{qfV_{dc}}{z_0} \tag{5}$$

where f is a constant which accounts for the particular trap geometry. The displacement Δ of the center of an ion's orbit from the center of the trap in such a field is approximately:

$$\Delta = \frac{F}{m\omega_z^2} \tag{6}$$

where $\omega_z$ is the angular frequency of the ion's axial motion in the quadrupolar trapping field of amplitude V and angular frequency ω.

For the case where the quadruolar component of the DC potential is zero, the following equations can be substituted into equation (6):

$$\omega_z^2 \approx \frac{2V^2}{\left(\frac{m}{q}\right)^2 r_0^4 \Omega^2} \tag{7}$$

$$(m/q)^* = \frac{2V}{0.908 z_0^2 \Omega^2} \tag{8}$$

$$r_2^2 \approx 2z_0^2 \tag{9}$$

where (m/q)* is the low mass cutoff at the specified trapping conditions. The result is the following equation:

$$\frac{\Delta}{z_0} \approx \left[\frac{f}{0.908}\right]\left[\frac{m/q}{(m/q)^*}\right]\left[\frac{V_{dc}}{V}\right] \tag{10}$$

The $\Delta/z_0$ ratio, which is also illustrated graphically in FIG. 4, represents the relative displacement of ions along the $z_0$ axis of the ion trap when influenced primarily by the dipolar DC field and the substantially quadrupolar RF trapping field. When the displacement Δ is equal to the fixed distance $z_0$ to endcap EC2, then $\Delta/z_0 = 1$ and those ions hit the endcap and are lost from the trapping field. For a $\Delta/z_0$ of less than one, the ions are located various distances from center such as illustrated in FIG. 4.

The supplemental waveform or FNF is applied in a dipolar fashion across the endcaps EC1 and EC2 to create a combined field which perturbs the ions from the orbit shown in order to selectively force resumption of charge state migrations to target lesser charge states representing higher m/z values. Assuming by way of example that the +6 ion is to be migrated to a lesser charge state, the FNF signal is adjusted to include a resonant frequency which perturbs the +6 ions with an amplitude so that the +6 ions move along an elongated orbit 138 which extends a distance Δ or slightly greater toward the center so as to overlap substantially the orbit of −1 ions. The overall cloud of +6 ions thus extends approximately from center to 2Δ as illustrated in FIG. 4. Importantly, the z-axis of oscillatory motion sweeps the +6 ions into the region of the −1 counter ion cloud. Because the multiply-charged +6 ions are moving slowly at the end of the orbit 138 nearest the center of the ion trap, the likelihood of a charge neutralization reaction is substantially increased. Thus, this dipolar FNF signal forces resumption of charge state migration reactions for +6 ions that otherwise would essentially halt due to the presence of the dipolar DC spatially separating the +6 ions from the counter ions.

The explanation of the forced resumption of CSM can be expressed quantitatively. Using methods similar to those used to derive equation (10), this result can be generalized to include the effect of a single frequency on-resonance FNF, and a viscous drag provided by the buffer gas which is usually added to the trap. Specifically, the case is considered with $\pm V_{FNF}\cos(\omega)$ being applied to the endcaps. With the ions experiencing a retarding force proportional to their velocity with proportionality constant s, the following equation provides a steady state solution for the ion's position as a function of time:

$$z(t) = \frac{2fV_{DC}}{mz_0\omega_z^2} + \frac{2fV_{FNF}}{mz_0 s\omega_z}\sin(\omega_z t) \tag{11}$$

Neglecting the relatively small displacement of the negative counter ions, the maximum forced resumption effect occurs where $V_{FNF}$ is chosen according to the following equation:

$$V_{FNF} = \frac{sV_{DC}}{\omega_z} \text{ or } V_{FNF} = V_{DC}\left(\frac{s}{\omega_z}\right) \tag{12}$$

With $V_{FNF}$ chosen as in equation (12), one turning point of the ion's oscillation occurs at the geometric center of the trap where the negative counter ions are located. The parameter s is dependent upon many factors and is complicated to derive mathematically, but it readily can be determined experimentally The displacement Δ caused by the dipolar DC should be less than one-half of $z_0$. To force a resumption for a range of multiply-charged analyte ions, the FNF signal is adjusted to have a range of RF frequencies to resonate the charge states to be migrated with amplitudes to cause each particular charge state orbit to end near the center of the trap and to overlap the counter ion cloud.

FIG. 5 illustrates in more detail the counter ion source 64 and associated apparatus. The counter ion source 64 can be a glow discharge ionization (GDI) device having a manifold chamber 140 with a vacuum port 142 connectable to a rough vacuum pump. Chamber 140 is electrically connected to ground 98. A central region 144 in the center of the chamber is maintained at a rough vacuum pressure such as 400 to 800 mTorr. A metal inlet plate 146, electrically isolated from the chamber by an O-ring, has a small diameter opening contiguous with an open cone shaped expander region 148 which opens into the center chamber 144.

The reagent sample 60 is connected by a pipe through a precision leak valve 62 to an ultraTorr connector 150 to pass the reagent through the expander region 148 and into the central region 144. Opposite the inlet plate 146 at the bottom of the chamber and sealed by an O-ring is an outlet plate 152 having a center small diameter opening contiguous with a cone shaped expander region 154.

A switchable counter ion power supply 162 when gated on generates a DC discharge voltage which is directly connected to the inlet plate 146. This DC voltage can be from −350 to −500 volts, and will cause glow discharge ionization or arcing to occur within the discharge chamber 144 and create negative reagent ions having a single negative charge of −1.

A series of electrostatic lens electrodes 68 are spaced by insulating rods 158 away from the exit opening 154 for the negative reagent ions created by the glow discharge. A first focusing lens L1 is annular and includes a hollow center sleeve opposite the cone expander opening 154. Downstream from lens L1 is a pair of split lenses L2A and L2B which are electrically isolated from each other. A final lens L3 is annular with a hollow center sleeve to cause negative ions 66 to be electrostatically focused onto the radial aperture 72 in the ring electrode. Four insulated feed-through conductors 160 couple DC voltages through the chamber 140 to the exit side for connections to the downstream lenses L1, L2A, L2B and L3.

An ion focus and transfer voltage supply 164 generates several static DC voltages necessary for electrostatic focusing of the negative ions. Typically, lens L1 is connected to 500 volts, lens L2B is connected to 200 volts, and lens L3 is connected to 50 volts. Gate lens L2A is connected to a switchable counter ion gate DC voltage supply 166 which can be switched between 0 volts (ground) and 200 volts. When the GDI source is to be gated off, the lens L2A is grounded. When the GDI source is to be gated on to allow the negative ions to be pushed outward along stream 66, the lens L2A is switched to 200 volts, i.e., the same static DC voltage on the lens L2B.

With the apparatus operated as described, an ion population consisting of multiply-charged analyte ions and singly-charged counter ions is established in the ion trap 20. In the absence of any intervention, these ions will react via charge exchange, usually proton exchange, wherein a proton from a positively charged species is transferred to a negatively charged species, until either the positive or negative ions are depleted. Positive, multiply-charged ions are usually formed by multiple additions of protons to a neutral molecule. Thus, the mass of the ion, m, is simply related to the mass of the neutral molecule, M, the mass of the proton, $m_p$, and the number of protons, n, that were added as follows:

$$m = M + nm_p \tag{13}$$

Furthermore, the charge on the ion, q is the charge of a proton, e, times the number of protons added, n. Then, the mass-to-charge ratio of the ion, m/q is stated as:

$$m/q = \frac{[M + nm_p]}{ne} \tag{14}$$

As a result of a single proton transfer reaction, a new ion is formed having a different mass-to-charge ratio, (m/q)', as follows:

$$(m/q)' = \frac{[M + (n-1)m_p]}{(n-1)e} \tag{15}$$

In a mass spectrometer, such a shift in mass-to-charge ratio of many such ions is observable as a reduction of the signal at m/q and the emergence or enrichment of a signal at (m/q)'. Another proton transfer reaction creates yet another new ion with mass-to-charge ratio (m/q)" and so on:

$$(m/q)'' = \frac{[M + (n-2)m_p]}{(n-2)e} \tag{16}$$

This process can be continued as long as negative counter ions are present even to the point that the neutral molecule is once again formed and thereupon lost from the ion trap. Table 1 gives a numerical example for Cytrochrome C (M=12360.1 amu) where the charge state or number of protons n, attached to the neutral molecule is shown in one column and the corresponding mass-to-charge ratio m/z of the ions is shown in the second column. The mass of the protons is taken, for simplicity to be 1 amu.

TABLE 1

| Charge State (n) | Mass-To-Charge Ratio |
|---|---|
| 1 | 12361.10 |
| 2 | 6181.05 |
| 3 | 4121.03 |
| 4 | 3091.03 |
| 5 | 2473.02 |
| 6 | 2061.02 |

TABLE 1-continued

| Charge State (n) | Mass-To-Charge Ratio |
|---|---|
| 7 | 1766.73 |
| 8 | 1546.01 |
| 9 | 1374.34 |
| 10 | 1237.01 |
| 11 | 1124.65 |
| 12 | 1031.01 |
| 13 | 951.78 |
| 14 | 883.86 |
| 15 | 825.01 |
| 16 | 773.51 |
| 17 | 728.06 |
| 18 | 687.67 |
| 19 | 651.53 |
| 20 | 619.01 |
| 21 | 589.58 |
| 22 | 562.82 |
| 23 | 538.40 |
| 24 | 516.00 |
| 25 | 495.40 |

Figure 8:
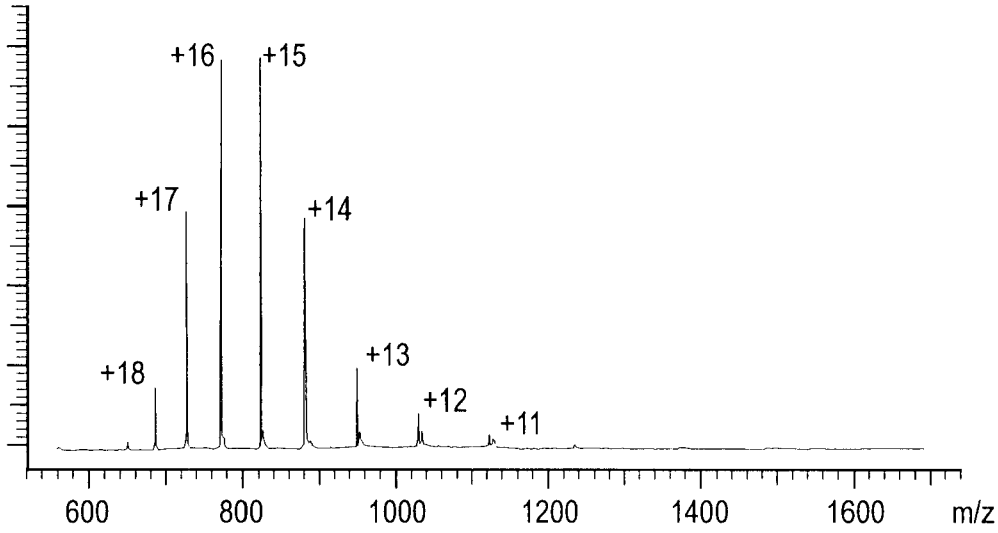
FIG. 8 illustrates a beginning mass spectrum for certain ions trapped by the ion trap of FIG. 1.

As is well known, the initial charge state distribution can be roughly represented by the mass spectrum of the multiply-charged analyte population in the absence of any ion/ion reactions and is shown in FIG. 8. When negative counter ions are allowed to react with the analyte ions for some time prior to mass analysis, the observed charge state distribution is seen to have shifted or migrated to lower charge states (higher mass-to-charge m/z ratios) as shown for example for Cytochrome C in FIGS. 9*a* to 9*c* to be explained. As such, this process is sometimes referred to as "Charge State Migration" or "CSM". Finally, it should be noted that instrument calibrations will affect observed m/z values which may deviate somewhat from the calculated values.

One known method of intervention, described by Scott A. McLuckey et al. in "Ion Parking During Ion/Ion Reactions in Electrodynamic Ion Traps", Analytical Chemistry, 74(2), 336–346, 2002, is to drastically reduce the rate of the charge transfer reaction for one charge state through application, during the reaction step, of a dipolar RF electric field of a single or narrow band of frequencies at or near resonance for the ions of the selected charge state(s). No dipolar DC is present so all multiply-charged positive ions have orbits about the center of the trap. The dipolar RF causes the selected desired ions of one charge state, i.e. the ions to be retained, to oscillate with relatively large amplitudes and, more importantly, to be moving relatively quickly when in close proximity to the counter ions that are held in the center of the trap. The rate constant for the charge transfer reaction for the selected ions is dramatically reduced in such a situation leading to a virtual suspension of the CSM process at the selected state(s).

In contrast, in this invention, a dipolar DC potential is employed to disperse the various charge states of the analyte ions along the direction of the applied field and also to separate the counter ions therefrom in a controlled manner as illustrated with reference to FIG. 4. An additional dipolar RF field is superimposed, not to stop the charge state migration process as in the McLuckey technique, but to force it to resume having been effectively halted by the dipolar DC field. In exemplary embodiments, the FNF signals are relatively broad band to force resumption of charge state migration for a range of higher charge states observed at m/z values below that of the target charge state.

To explain the process of charge state migration or CSM, the following example is given for an analyte ion having a +9 charge state and an m/z of 1374.34 as indicated in the above Table 1. An ion/ion proton transfer reaction with a −1 counter ion transforms the ion in the +9 charge state into an ion in the +8 charge state with a new observable m/z of 1546.01. A further ion/ion reaction with another −1 ion again migrates the analyte ion to n=+7, and an observable m/z of 1766.73. Continuing ion/ion reactions thus cause the observed m/z to move upwardly, such as from an m/z of about 1374 to about 1546 and then about 1767 and so forth. Unless controlled or inhibited in some manner, the analyte ions will continue to migrate to higher m/z until the neutral molecule is formed or the practical trapping limit of the trap is reached and hence become lost. However, the use of a combination of dipolar DC and dipolar RF, following the process steps given herein, will control the migration before the analyte ions are lost in the manner described above. As a result, the ions from a given analyte molecule can be concentrated in a single charge state for subsequent processing at relatively high sensitivity.

Figure 6:
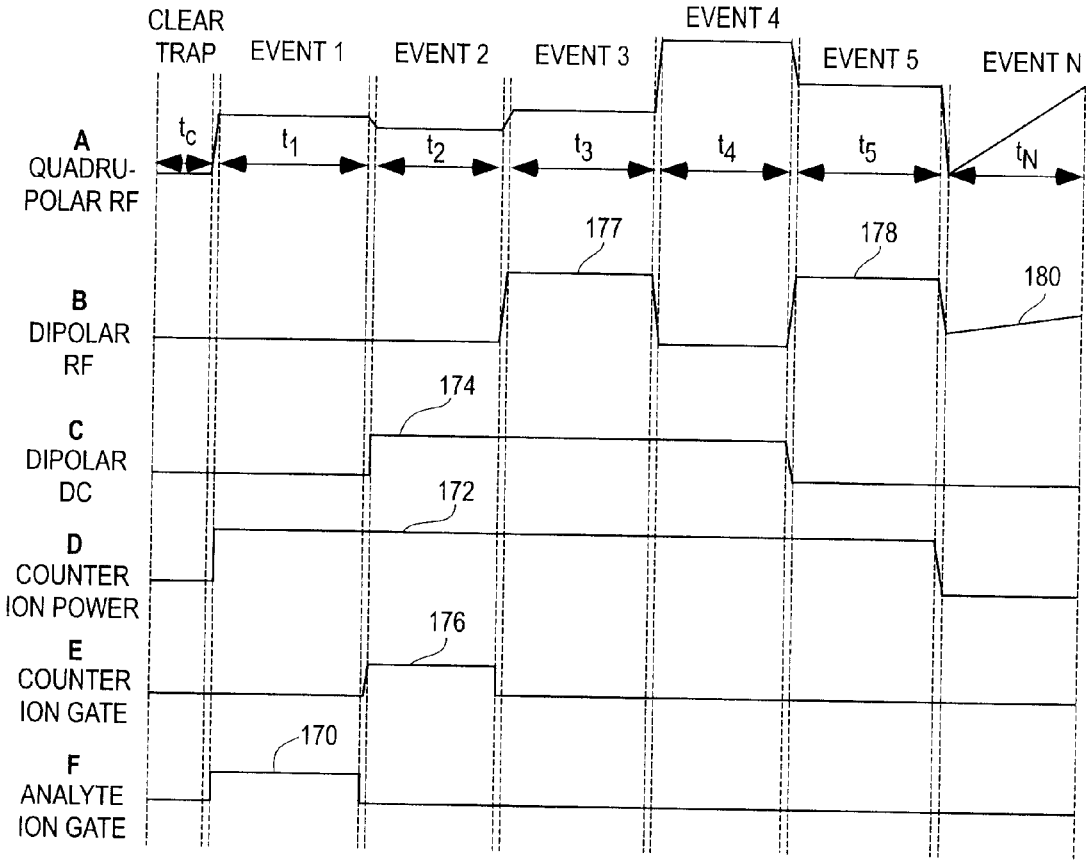
FIG. 6 shows several related timing diagrams for operating the ion trap in accordance with the invention.

FIG. 6 shows the timing diagrams, labeled A through F, for the various applied signals for operating the ion trap 20 in accordance with the present methods of using dipolar DC and dipolar RF in a manner to control charge neutralization reactions between the analyte positive ions and counter negative ions. Waveform A shows a quadrupolar RF drive applied to the ring by RF drive source 110 of FIG. 3 and having an amplitude (vertical axis) of V. Waveform B shows dipolar RF signals across the endcaps, and waveform C shows a dipolar DC signal across the endcaps, as generated by the circuit of FIG. 3. Waveform D shows the counter ion power generated by supply 162 in FIG. 5. Waveform E shows the counter ion gate produced by circuit 166 in FIG. 5. Waveform F shows the gate signal supplied by switch circuits 46 of FIG. 1 to the analyte ion source 32. Each event or step occurs during a corresponding time period t (horizontal axis) which is variable and controlled by the software and firmware in the on-board computer 42. The individual time periods t are not shown to scale, and generally can vary substantially between adjacent steps or events. Desirably, each time period t can be adjusted in duration by an operator, in addition to having preselected values controlled by the software to perform certain standard operations. Between the time periods t, a small time interval exists to provide a transition time sufficient for the waveform pulses to change states and stabilize between each event.

Turning more specifically to the methods of operating the ion trap using the FIG. 6 timing waveforms, the ion trap is initially cleared during a clear trap period $t_c$. During period $t_1$, the quadrupolar RF drive A is adjusted in amplitude V so as to trap the positive analyte ions, and is adjusted during $t_2$ so as to simultaneously trap the positive analyte ions and negative reagent ions by maintaining the ions within the stability envelopes 80 and 82 of FIG. 2C. The analyte ion gate signal F generates a pulse 170 which goes high during $t_1$, to gate on the analyte ion source 32 and thus cause multiply charged positive analyte ions to accumulate in the ion trap during Event 1. Time period $t_1$, is typically several hundred ms. Also during $t_1$, the counter ion power signal D generates a high going pulse 172 to gate on the counter ion power supply 162 of FIG. 5 to begin the glow discharge. However, no counter ions pass to the ion trap since the counter ion gate signal E remains low during period $t_1$.

During time period $t_2$, the dipolar DC signal C generates a high going pulse 174 to activate the trigger blocks 130 of FIG. 3 and thereby apply dipolar DC across the endcaps EC1 and EC2. During the same time period $t_2$, the counter ion gate signal E generates a high going pulse 176 which causes power supply 166 of FIG. 5 to switch from ground to the same static DC voltage on lens L2B. This gates on the GDI source and causes singly charged negative counter ions to pass into and accumulate in the ion trap 20 during Event 2. Preferably, the analyte ions and counter ions are accumulated in sequential steps, but the order of introduction can vary as will be explained. It is possible to eliminate use of the gate signal E and instead switch on and off the counter ion power pulse 172 to control counter ion accumulation. However, use of a gate signal 176 to control the gate electrostatic lens L2A of the GDI device is preferable to produce a more stable operation for introducing or ceasing counter ion accumulation in the ion traps. Time period $t_2$ of counter ion accumulation is typically 10 ms to several 10 s of ms and can be selected by an operator.

In the exemplary embodiments, at least one of the analyte ions and counter ions are introduced radially and the other axially. The axially introduced ions should be introduced first during period $t_1$, and then the radially introduced ions should be introduced second during period $t_2$ and simultaneous with the presence of the dipolar DC field. For this embodiment, the dipolar DC goes on during radial ion accumulation $t_2$ and is continuously on during and spans the partial neutralization reaction and suspension period $t_3$ and quench period $t_4$ and then is terminated. As will be explained later, the order as well as the direction of introduction of the analyte ions and counter ions can be changed from the example illustrated.

During time period $t_3$, which typically is several hundred ms to several thousand ms, the quadrupolar RF drive A can be adjusted to have a higher amplitude V in order to set the low m/z cutoff to a higher value. The dipolar DC signal 174 remains high during $t_3$ so that the ion cloud of the selected charge state, or m/z, will tend to remain largely spatially separated from that of the counter ions thereby tending to inhibit further CSM reactions. The dipolar RF waveform B goes high to create pulse 177 during period $t_3$ to cause the FNF source 90 in FIG. 3 to generate a supplemental RF signal (FNF) selected to force a resumption of the CSM reactions which otherwise would be suspended by the presence of the dipolar DC field alone. In particular, the FNF signal comprises RF which spans a medium to broad range of frequencies to thereby perturb a range of multiply-charged ions which are to be migrated to different charge states representing higher mass-to-charge ratios. The period $t_3$ is typically longer than a corresponding time period for application of a dipolar DC signal without the presence of dipolar RF. The net result is a better concentration of target ions.

Figure 7:
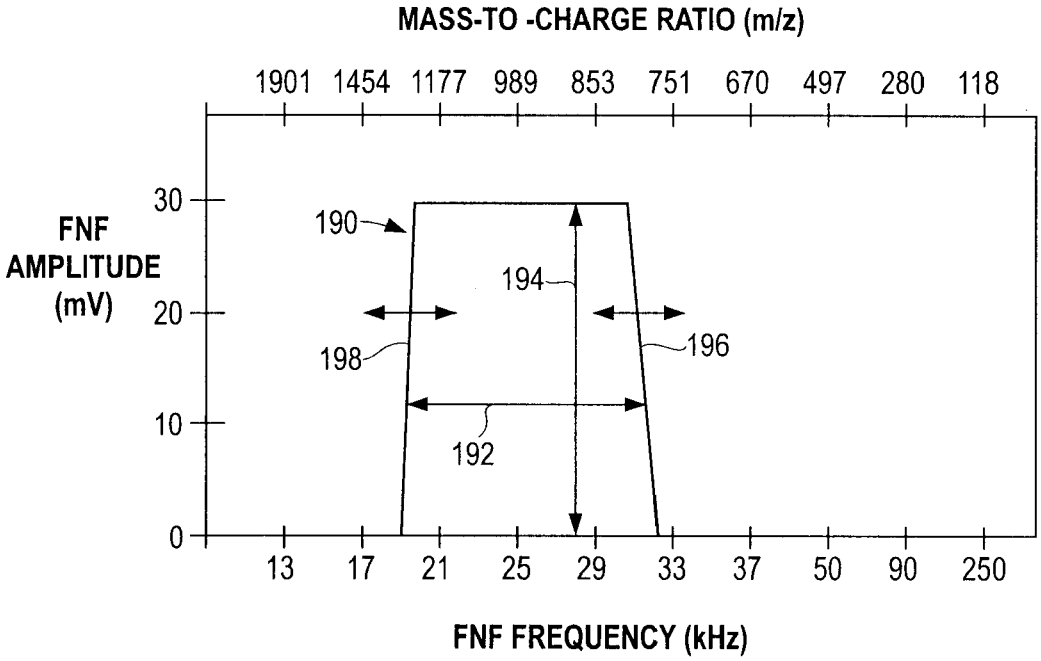
FIG. 7 is a waveform diagram for the dipolar supplemental RF signal, also known as FNF, generated by the control system of FIG. 3.

More particularly, the dipolar RF signal generated by the FNF source 90 in FIG. 3 desirably has an envelope 190 as seen in FIG. 7. The waveform envelope has a variable frequency bandwidth 192 and a variable amplitude 194, and optionally can include frequency notches (not illustrated) within the overall envelope. The bandwidth 192 is adjustable over a wide span of RF frequency ranges such as from about 10 kHz to about 400 kHz. Each RF frequency within the span of frequencies will excite ions of particular mass-to-charge ratio (m/z). The correspondence between the lower and upper horizontal scales, illustrated in FIG. 7, i.e., FNF frequency (kHz) and mass-to-charge ratio (m/z), is applicable for a particular low m/z cutoff, which in the illustrated example is 100 amu/e, and a particular quadrupolar drive frequency, which in the illustrated example is about 770 kHz. One high frequency edge 196 of the RF waveforms is adjusted to correspond to a lower m/z limit for the ions to be excited. An upper m/z limit is selected by a lower frequency edge 198 of the RF waveforms. Preferably, the operator presets a lower m/z limit and an upper m/z limit, and the software of the control system then calculates the corresponding RF frequencies within envelope 192. If desired, however, the software can allow the operator to set the actual RF frequencies to be generated. If only a single m/z ion is to be excited, then the edges 196 and 198 collapse to a single frequency spike corresponding to the selected m/z value. The variable amplitude 194 is settable by the operator.

For purposes of the present invention, the dipolar RF waveform 177 in FIG. 6 triggers on the FNF source 90 to generate an FNF waveform having a medium to broad bandwidth 192 corresponding to an ion range such as from 600 to 1200 m/z or so. The higher frequency edge 196 is selected to excite a lower m/z of about 800, sufficient to excite a +15 charge state analyte ion. The lower frequency edge 198 is adjusted to correspond to an upper m/z limit of about 1200, to excite analyte ions of about +11 charge state. A nominal amplitude 194 of 30 mV is sufficient to resonate this group of ions with orbits which end at and overlap the cloud of negative reagent ions. As indicated by equation (12), it can be beneficial to tailor the amplitude of the FNF as a function of frequency by giving the waveform 190 a slope along its top edge. However, for many cases, a flat FNF top edge works sufficiently well for narrow to medium ranges of frequencies such as illustrated in FIG. 7.

During event 3, partial neutralization reactions occur with the dipolar DC tending to suspend the reaction and the dipolar RF signal tending to force a resumption of the charge state migration to a higher m/z range. The reason for suspension is that positive analyte ions of higher mass-to-charge will move towards one endcap and will orbit more away from the negative reagent ions which are biased by the dipolar DC towards the other endcap as shown in FIG. 4. The amplitude of the adjustable dipolar DC is set to a low voltage which typically is several hundred millivolts to several volts in order to displace the orbits, but not eject the ions, which are to be maintained within the three dimensional trapping field. As multiply-charged positive ions are allowed to undergo ion/ion reactions with single charged negative ions, the positive ions migrate to one lesser positive charge state, and then migrate again and again to lower charge states and hence higher m/z ratios. The negative counter ion population is partially depleted in this process which probably serves to further increase the separation of the remaining charged ion populations.

As shown by equation (10), the displacement of an ion from the center of the trap is related to the m/q of the ion, the low m/z cutoff, the dipolar DC voltage, and the amplitude V of the quadrupolar RF drive signal. The duration of the reaction event $t_3$ as well as the initial sizes of the two ion populations will also affect the extent of the reactions. However, pursuant to equations (11) and (12), the presence of dipolar RF voltage will tend to force a resumption of the charge state migration to a higher m/z value and thus concentrate the analyte ions into a given charge state. This is useful for further processing steps such as isolation or purification (from analyte ions of a different type) and MS/MS analysis. Each of the adjustable parameters, or any combination thereof, may be varied by the operator and preselected to control the target charge state at which the migration is effectively halted. Desirably, the operator preselected parameters are implemented by the software controlling the operation of the ion trap.

During time period $t_4$, the dipolar DC pulse 174 remains high so that the dipolar DC field continues in the ion trap. The dipolar RF signal 177 is terminated to cease the dipolar RF field. The voltage V of the quadrupolar RF drive A is raised substantially to raise the low m/z cut-off of the ion trap to expel the negative reagent ions, which typically have a lower m/z ratio than the analyte ions. This drives the counter ions out of the ion trap to prevent any further charge state migrations. Other methods of quenching the reaction are possible. After expulsion of the counter ions, at the end of Event 4, the dipolar DC pulse 174 is terminated as it is no longer necessary for controlling the ion/ion reactions. Thus, Event 4 is a quench operation to eliminate the counter ions while leaving the remaining target analyte ions in the ion trap.

During time period $t_5$ and any further time periods needed, further processing of the remaining analyte ions can begin. For example, cooling can occur. As another example, the voltage V of the quadrupolar RF can be changed to adjust the low m/z cut-off and the dipolar RF signal can generate a pulse 178 to generate an FNF signal adjusted to perform a desired operation such as isolation or CID.

During a final time period $t_n$, the remaining analyte ions which have been processed are scanned and ejected in mass sequential order to create a mass spectrum. For this purpose, the quadrupolar RF drive A is reduced and then increased along a ramp V. Additionally, the dipolar RF signal B generates a pulse 180 which also ramps upward with time. The pulse 180 causes the FNF source 90 of FIG. 3 to generate a single frequency chosen to correspond to a specific point along the $a_z$=0 axis of the stability diagram within the stable trapping region. In effect, the frequency span 192 seen in FIG. 7 is narrowed to a single frequency rather than the medium width frequency shown in FIG. 7. The single FNF frequency, establishes a resonance point or hole in the stability diagram at a particular $q_z$. The ramping of the RF drive A then causes ions of successively higher m/z to arrive at that point whereupon they are ejected to the detector. The resonant point is chosen so as to achieve a given scanning m/z range for the trap. Other means of generating a mass spectrum exist and are known to those skilled in the art.

Various mass spectra resulting from operating the ion trap according to the present invention are illustrated in FIGS. 8, 9*a* to 9*c* and 10*a* to 10*c*. Each spectrum has a horizontal axis representing the m/z values and a vertical axis representing intensity or abundance. The peaks have been labeled with the corresponding charge states for the particular analyte ions under investigation. The ion trap described herein was operated using as the analyte Cytochrome C having a molecular weight of 12360.1 amu. An electrospray of this analyte resulted in numerous of the high charge states listed in Table 1. The reagent used was perfluoro-dimethylcyclohexane (C8F16) having a molecular weight of 400 amu. A glow discharge ionization of this reagent resulted in singly-charged counter ions having a −1 charge state observable at various m/z values owing to fragmentation within the source.

FIG. 8 illustrates the beginning mass spectrum of trapped ions, i.e., when the counter ion gate remains off during time period $t_2$. Peaks occurred for +11 through +18 charge states of the analyte ions. The peaks were of medium intensity for +14 and +17 analyte ions, and of high intensity for +15 and +16 analyte ions centered around 800 m/z. Absent a method to suspend CSM, the charge state migration reactions would cause all analyte ions to become lost by mechanisms previously described.

Figure 9A:
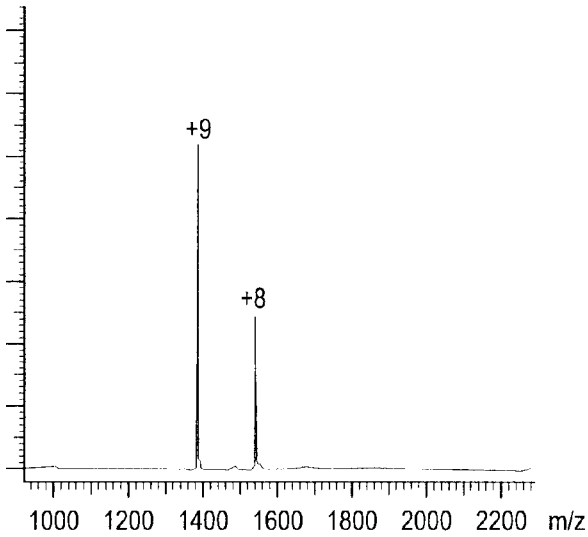
FIGS. 9*a* to 9*c* illustrate several mass spectra produced by operating the ion trap in accordance with the signals of FIG. 6 and 7.
Figure 9B:
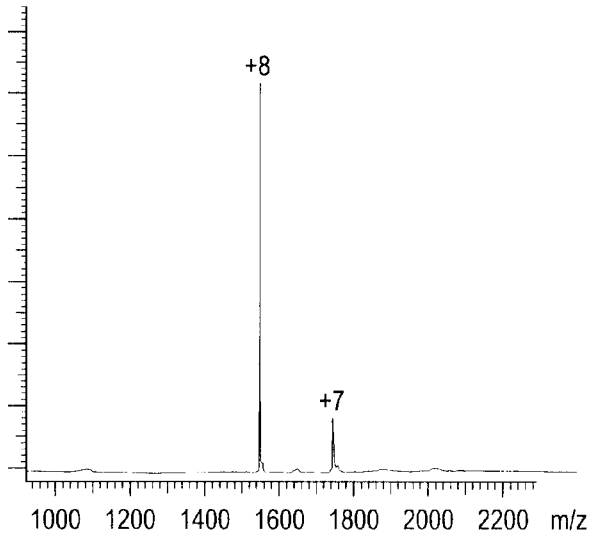

FIGS. 9*a*, 9*b*, and to 9*c* illustrate the results of operating the ion trap to migrate the initial charge state distribution of FIG. 8 to desired target charge states of +9, +8, and +7, respectively. It should be noted that the m/z scales in FIGS. 9*a* to 9*c* have been shifted to a higher range beginning about 1000 m/z whereas the m/z scale for the initial mass spectrum of FIG. 8 begins at about 600 m/z. The values of the dipolar DC and the dipolar RF parameters are preselected by an operator so that the combination of dipolar DC induces suspension of CSM and the dipolar RF (FNF) forces resumption of CSM to particular target charge states. The target charge states illustrated were produced by adjusting the parameters for operating the ion trap to have the following values in Table 2:

TABLE 2

Figure 9C:
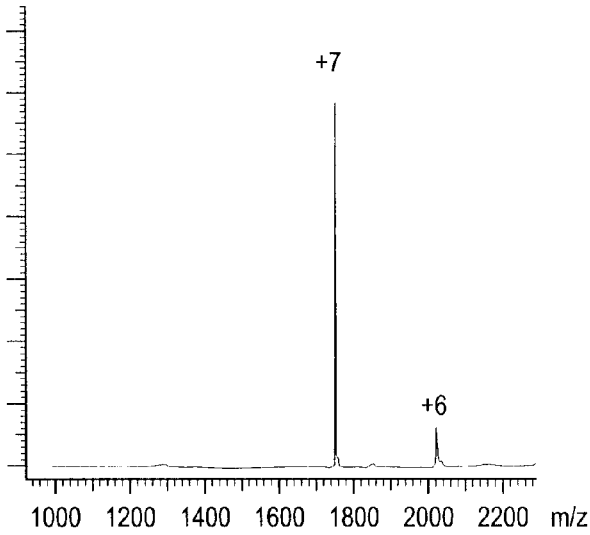

| |
|---|
| $t_1$ = 300 ms |
| $t_2$ = 65 ms |
| $t_3$ = 1500 ms |
| $t_4$ = 10 ms |
| $t_5$ = 100 ms |
| low m/z cutoff = 100 |
| for Events 2 and 3 |
| Dipolar DC = ±3.0 volts |
| for Events 2 to 4 |
| Dipolar RF for Event 3 |
| Amplitude = 72 mV |
| low m/z = 1000 |
| high m/z = 1350 for |
| FIG. 9a |
| high m/z = 1550 for |
| FIG. 9b |
| high m/z = 1750 for |
| FIG. 9c |

When the dipolar FNF was adjusted to have RF signals resonating ions from 1000 to 1350 m/z, the initial mass spectrum of FIG. 8 was transformed to that shown in FIG. 9*a* where primarily the +9 charge state is in evidence. A lesser amount of ions were migrated to the lower +8 charge state. For the same operating parameters but adjusted so that the FNF would excite ions corresponding from 1000 to 1550 m/z, the ions migrated primarily to the +8 charge state, with a lesser amount to +7, as illustrated in FIG. 9*b*. Finally, when operated so that the FNF range excited ions from 1000 to 1750 m/z, the ions migrated to and were substantially halted at the +7 charge state, with still fewer at +6, as seen in the mass spectrum of FIG. 9*c*. Thus, by changing the position of the FNF's high frequency edge 196 of FIG. 7, the migrations can be halted at desired target charge states for further analysis and processing.

Figure 10A:
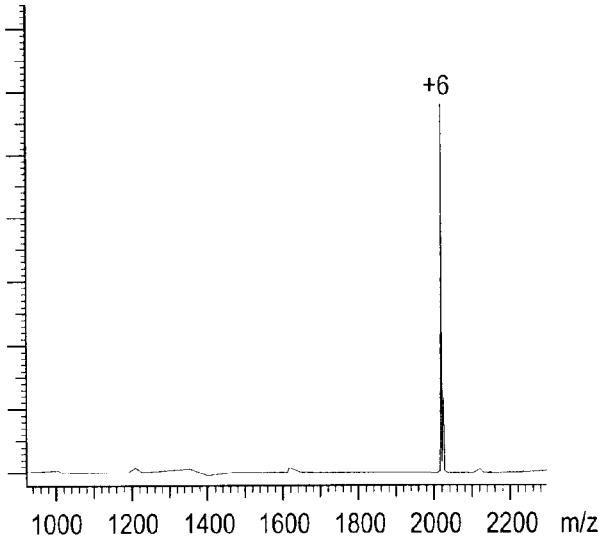
FIGS. 10*a* to 10*c* illustrate further mass spectra produced by operating the ion trap in accordance with the signals of FIGS. 6 and 7 including the effect of varying the amplitudes of the dipolar RF signals.
Figure 10B:
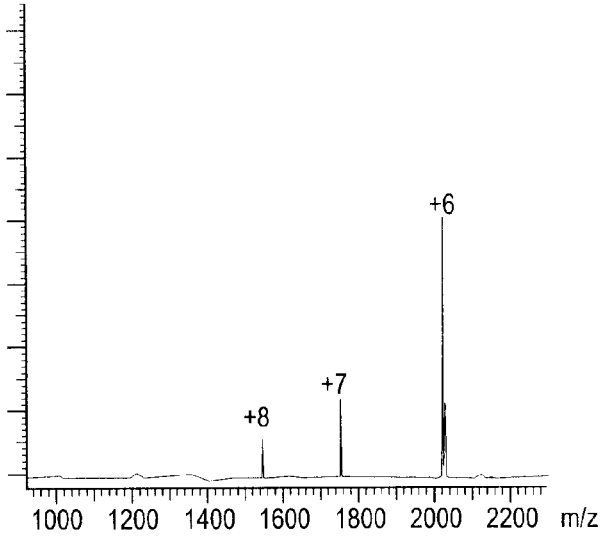
Figure 10C:
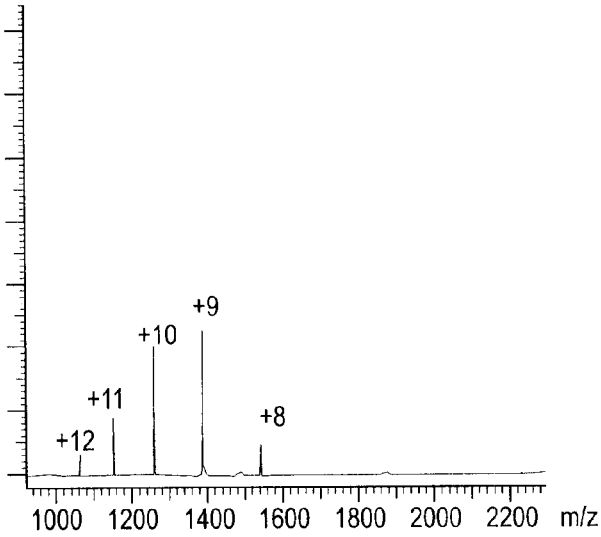

FIGS. 10*a* to 10*c* illustrate the effects of using different amplitudes of FNF, with a fixed amount of dipolar DC, on the resulting mass spectra. FIG. 10*a* illustrates operating the ion trap with the parameters in Table 2 except that the FNF for event 3 excited ions from a low m/z=1000 to a high m/z=2000. This continued the progression seen in FIGS. 9*a*, 9*b*, 9*c*, and migrated the mass spectrum to the +6 charge state, as shown in FIG. 10*a*.

In contrast, FIG. 10*b* illustrates operating the ion trap with the same parameters as FIG. 10*a* except that the FNF voltage was doubled to two times the amplitudes used for FIG. 10*a*. This displaced the orbit ends further away from the center of the ion trap so the migration to the +6 target charge state did not progress as far and was incomplete. As illustrated in FIG. 10*b*, amounts of +7 and +8 ions remained since the FNF voltage was too large to optimize migration to a charge state of +6.

FIG. 10*c* illustrates operating the trap with the same conditions as FIG. 10*a* except that the FNF voltage was three times the amplitudes used for the FIG. 10*a* mass spectra. A substantial population of ions exist from +12 to +8 charge states. Thus, the migration was stopped at early stages because the FNF amplitudes were too high relative to the dipolar DC amplitude to force migration to continue to the +6 charge state. To maximize the population of ions at a particular charge state, therefore, the relative amplitudes of dipolar DC and dipolar RF voltages must be coordinated so that ion clouds whose migrations are to continue have orbits ending spatially in the vicinity of the counter ion cloud.

In the exemplary embodiment, the analyte ions are introduced axially while the counter ions are introduced radially. However, virtually any direction can be chosen for introduction of either ion stream. Furthermore, the two streams are introduced at distinct times and with analyte ions entering first in the experimental sequence in the exemplary embodiment. This is not a requirement and analyte and counter ion streams can enter the trap at the same times, partially or completely, or their orders can be reversed. In the illustrated embodiment, the dipolar DC is on whenever both types of ions are present in the trap, and dipolar DC is known to degrade or enhance the trapping efficiency of ions introduced in any direction other than strictly radially. No such effect has been observed for ions introduced radially. Thus, care needs to be taken in situations where ions with an axial component of velocity enter the trap when ions of the opposite polarity are already trapped. When one set of ions is introduced axially, the dipolar DC pulse 174 can be off during the axial introduction, as shown.

Both the analyte ions and the counter ions can be introduced radially. Both sets of ions could enter radially through the same hole, or alternatively, two sets of radial openings can extend through the ring electrode 22 at offset angles from each other. When both the analyte ions and the counter ions are introduced radially, then the dipolar DC pulse 174 of FIG. 6 can be pulsed on any time, and the pulse 174 does not need to coincide with the counter ion gate pulse 176. Furthermore, the dipolar DC pulse 174 can be left on during later time periods for ejection if the dipolar DC field is oriented to push the ions to be analyzed in the direction of the detector.

The counter ion source 64 in the exemplary embodiments is a glow discharge ionization (GDI) source. It is generally desirable to leave the glow discharge running at all times in order to achieve a more stable source. However, the glow discharge can disturb certain types of ion detectors resulting in a large baseline noise. When the ion detector 50 of FIG. 1 is a photoelectron multiplier detector, then it is desirable to use two triggered power supplies 162 and 166 as seen in FIG. 5, and terminate the power pulse 172 before scan period $t_n$ when the ion detector is being utilized. However, if the ion detector 50 is a different type, such as a conversion dynode/electron multiplier design, then the GDI power supply can be left on at all times and use the gate pulse 176 to control when the counter ions are to be introduced into the ion trap.

Further changes and modifications will be apparent to those of ordinary skill in the art.

What is claimed is:

1. A method of controlling an ion trap comprising the steps of generating a trapping RF field for simultaneous trapping of positive ions and negative ions, trapping first ions having charge states of one polarity by the trapping RF field, trapping second ions having charge states of opposite polarity by the trapping RF field, at least one of the first ions and second ions being in a multiply-charged state, generating a DC field having a variable amplitude, generating a supplemental RF field having a variable frequency, applying a combination of the DC field at a selected amplitude and the supplemental RF field at at least one selected frequency to control charge state neutralization reactions between the first ions and second ions and migrate at least certain of the multiply-charged state ions to at least one lesser charge state having a higher mass-to-charge ratio.

2. The method of claim 1 in which the supplemental RF field has a variable amplitude in addition to the variable frequency and the variable amplitude is adjusted to perturb but not eject ions during at least portions of a time period of applying the combination of the DC field and the supplemental RF field.

3. The method of claim 1 in which the supplemental RF field has a variable amplitude, and the amplitudes of the DC field and the RF field are adjusted so that orbits of certain ones of the multiply-charged state ions overlap with other of the first ions and second ions and different ones of the multiply-charged state ions are separated in space to halt charge state neutralization reactions.

4. The method of claim 1 in which the supplemental RF field has a frequency range extending from a lower frequency to a higher frequency and can be adjusted to select a narrow to a broad span of frequencies within the frequency range.

5. The method of claim 1 in which a range of frequencies is selected for the supplemental RF field to perturb analyte ions having a range of mass-to-charge ratios.

6. The method of claim 1 in which the supplemental RF field is a dipolar RF field applied to first ions and second ions.

7. The method of claim 6 in which the DC field is a dipolar DC field applied to first ions and second ions whereby both the supplemental RF field and the DC field are substantially dipolar.

8. The method of claim 1 in which the DC field is a substantially dipolar DC field to separate in space the positive ions and the negative ions to control charge state neutralization reactions therebetween.

9. The method of claim 1 in which the variable amplitude of the DC field is adjustable by an operator to the selected amplitude which is maintained while applying the combination of the DC field and the supplemental RF field.

10. The method of claim 1 in which an operator can vary a time duration of applying the combination of the DC field and the supplemental RF field.

11. The method of claim 1 including applying for a first time period the DC field while suppressing the supplemental RF field, and applying for a second time period the combination of the DC field and the supplemental RF field.

12. The method of claim 11 in which the first time period occurs during at least one of the trapping first ions and the trapping second ions.

13. The method of claim 1 in which the ion trap has at least a pair of spaced electrodes, and the DC field is created by applying a first DC voltage of an adjustable amplitude to one of the electrodes and applying a second DC voltage of different characteristics to the other of the electrodes.

14. The method of claim 13 in which the first DC voltage and second DC voltage are of equal magnitude but opposite polarity and are adjustable by an operator.

15. The method of claim 1 including establishing an initial period for accumulating of first ions and second ions and another time period for applying the DC field which overlaps at least a portion of and extends beyond the initial time period.

16. The method of claim 15 including establishing a third time period later than the initial time period and which overlaps at least a portion of the another time period for applying the combination of the DC field and the supplemental RF field whereby the supplemental RF field is applied for only a portion of the time period of applying the DC field.

17. The method of claim 1 in which the one of the first ions and second ions have a plurality of different multiply-charged states to create a distribution of higher multiply-charged states.

18. The method of claim 1 including expulsion of one of the first ions and second ions after applying the combination of the DC field and the supplemental RF field to prevent further charge state neutralization reactions.

19. The method of claim 18 including continuing the DC field during quenching and adjusting the trapping RF field to eliminate the one of the first ions and second ions.

20. A method of controlling an ion trap comprising the steps of generating a trapping RF field for simultaneous trapping of positive ions and negative ions, accumulating first ions having charge states of one polarity within the trapping RF field, accumulating second ions having charge states of opposite polarity within the trapping RF field, at least one of the first ions and second ions having a range of multiply-charged states representing different mass-to-charge ratios, applying a DC field to spatially separate the first ions and second ions, and applying a supplemental RF field having a range of supplemental RF frequencies to perturb at least some of the range of multiply-charged states to cause migration to different charge states representing higher mass-to-charge ratios.

21. The method of claim 20 in which applying the DC field occurs during a first time period and applying the supplemental RF field occurs during a second time period which at least partially overlaps the first time period to create a combination of the DC field and the supplemental RF field.

22. The method of claim 21 in which the second time period is shorter in duration than the first time period whereby the DC field is applied both before and after the applying of the supplemental RF field.

23. The method of claim 20 including expulsion of the other of the first ions and second ions during a time period following applying of a combination of the DC field and the supplemental RF field to quench further reactions between the first ions and second ions in order to maintain at least one of the different charge states.

24. The method of claim 23 in which the expulsion occurs by adjusting the low mass-to-charge cutoff for the trapping RF field to eliminate the other of the first ions and second ions.

25. The method of claim 20 including varying at least one parameter of the trapping RF field, applying the DC field, and applying the supplemental RF field to select a particular one of the different charge states as a target charge state.

26. The method of claim 25 in which the step of varying at least one parameter includes allowing an operator to select an adjustable amplitude for the DC field.

27. The method of claim 25 in which the step of varying at least one parameter includes adjusting the range of supplemental RF frequencies to thereby change the target charge state.

28. The method of claim 20 in which the ion trap has at least a pair of spaced electrodes, and the DC field is created by applying a positive polarity DC voltage to one of the electrodes and applying a negative polarity DC voltage to the other of the electrodes.

29. The method of claim 28 in which the supplemental RF field is created by applying one polarity of supplemental RF voltage to one of the electrodes and applying an opposite polarity of the supplemental RF voltage to the other of the electrodes whereby both the DC potential and the supplemental RF potential are applied substantially dipolar.

30. The method of claim 20 in which the ion trap is at least a pair of spaced electrodes, and the supplemental RF field is created by applying one polarity supplemental RF voltage having the range of supplemental RF frequencies to one of the electrodes and applying an opposite polarity of the supplemental RF voltage to the other of the electrodes to thereby create a dipolar supplemental RF field.

31. The method of claim 20 in which the other of the first ions and second ions are created by ionization of a reagent to produce at least a singly-charged state.

32. The method of claim 20 including establishing an accumulation time period for accumulating first ions and accumulating second ions, and establishing a separate time period for applying the DC field which overlaps at least a portion of and extends beyond the accumulation time period.

33. The method of claim 20 including adjusting an amplitude of the DC field and an amplitude of the supplemental RF field so that some of the ranges of multiply-charged states will migrate and others of the range of multiply-charged states will substantially halt migration to different charge states.

* * * * *